US006492317B1

(12) United States Patent
Kerobo et al.

(10) Patent No.: US 6,492,317 B1
(45) **Date of Patent: *Dec. 10, 2002**

(54) HIGH FORMING HARD SURFACE CLEANING FORMULATIONS

(75) Inventors: Charles O. Kerobo, Southfield, MI (US); Michael C. Welch, Woodhaven, MI (US); Richard J. Holland, Flanders, NJ (US); Susanne M. Gessner, Ypsilant, MI (US); Sonia J. Patterson, Detroit, MI (US); Chacji Thankachan, West Bloomfield, MI (US)

(73) Assignee: BASF Corporation, Mount Olive, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/573,209

(22) Filed: May 19, 2000

(51) Int. Cl.[7] ..... C11D 1/722; C11D 3/37

(52) U.S. Cl. ..... 510/421; 510/238; 510/239; 510/240; 510/413; 510/475; 510/506; 510/535

(58) Field of Search ..... 510/238–240, 510/413, 421, 475, 506, 535

(56) References Cited

U.S. PATENT DOCUMENTS

| | | | | | |
|---|---|---|---|---|---|
| 4,491,526 | A | | 1/1985 | Deck | 252/32.5 |
| 4,663,082 | A | | 5/1987 | Bobsein et al. | 252/530 |
| 4,832,868 | A | * | 5/1989 | Schmid et al. | 252/356 |
| 4,904,359 | A | | 2/1990 | Pancheri et al. | 252/548 |
| 5,382,376 | A | | 1/1995 | Michael et al. | 252/153 |
| 5,501,816 | A | * | 3/1996 | Burke et al. | 252/174.21 |
| 5,518,648 | A | | 5/1996 | Welch et al. | 252/174.22 |
| 5,536,438 | A | | 7/1996 | Scialla et al. | 510/372 |
| 5,967,157 | A | * | 10/1999 | Chatterjee et al. | 124/25.2 |
| 6,133,218 | A | * | 10/2000 | Kerobo et al. | 510/365 |
| 6,342,474 | B1 | * | 1/2002 | Kerobo et al. | 510/405 |

FOREIGN PATENT DOCUMENTS

| | | |
|---|---|---|
| EP | 0 392 394 | 10/1990 |
| WO | WO 91/10718 | 7/1991 |
| WO | WO 97/39094 | 10/1997 |

* cited by examiner

*Primary Examiner*—Gregory Delcotto
*Assistant Examiner*—Brian P. Mruk
(74) *Attorney, Agent, or Firm*—Nixon & Vanderhye P.C.

(57) ABSTRACT

Hard surface cleaning formulations include an associative thickener and a blend of at least two nonionic surfactants selected from the group consisting of ethoxylated alcohols and ethoxylated fatty acids. The formulations exhibit an advantageously high foam volume of at least about 150 cc when a 100 ml aqueous solution containing about 0.1 wt. % of the formulation is agitated at 2,500 rpm for a cumulative agitation period of about 1200 seconds. The formulations also exhibit satisfactory foam stability sufficient to clean at least about 25 plates (ASTM D4009-92). Preferably, the associative thickener is the reaction product of a C6 or greater epoxide compound with a polyoxyalkylene polyol. The ethoxylated alcohols and ethoxylated fatty acids each most preferably contain C8 to C18 carbon chains which are ethoxylated with between about 3 to about 20 moles of ethylene oxide. Especially preferred ethoxylated alcohols are fatty alcohols having oxyethylate moieties of the general formula $R(OCH_2CH_2)_xOH$, wherein R is a C10 to C13 branched or straight chain alkyl group and x is within the range of about 4 to about 10.

16 Claims, No Drawings

HIGH FORMING HARD SURFACE CLEANING FORMULATIONS

FIELD OF THE INVENTION

The-present invention relates generally to hard surface cleaners. In particular, the present invention relates to hard surface cleaners that are effective to clean soils normally found in household, industrial and/or institutional environments and which exhibit improved cleaning, high foaming and less temperature dependent Theological properties.

BACKGROUND AND SUMMARY OF THE INVENTION

Hard surface cleaners that clean soils commonly found in household, industrial and/or institutional environments are known. Specifically, cleaners are known which are capable of cleaning a variety of soils, such as petroleum and fatty acids, particulate, oxidizable, proteinaceous triglyceride soils or soils normally found on hard surfaces such as dishes, glasses, tiles, fiberglass, steel, aluminum, plastic, wood, cement and the like. While these known formulations may work adequately under normal conditions, they are generally deficient in low temperature applications since their flow characteristics are susceptible to significant changes in temperature. In addition, many known hard surface cleaners are typically incompatible with sanitizing solutions as they tend to deactivate the active sanitizing ingredient(s).

U.S. Pat. No. 4,663,082[1] discloses a high pH water-based industrial cleaning composition comprising a series of anionic surfactants, builders and alkalinity agents. U.S. Pat. No. 4,904,359 discloses high sudsing liquid detergent compositions which contain an anionic surfactant and a polymeric surfactant containing ether linkages, the anionic surfactant forming stable complexes with the polymeric surfactant for improved grease handling.

[1] The entire content of each patent and publication cited herein is expressly incorporated by reference.

International Application No. 91/10718 discloses a composition requiring at least one anionic surfactant and at least one monocarboxylic acid. EPO 0392394B1 discloses a degreasing composition and a surfactant comprises of a nonionic surfactant of the polyoxyalkylene ether-type with a phosphate polyethylene oxide adduct. This mix is combined with a necessary amount of alkali builder of varying types. The phosphate moiety is responsible for increasing the generation of foam and, as is known, represents an environmental concern.

U.S. Pat. Nos. 5,518,648 and 5,382,376 disclose detergent compositions containing ethylene oxide-propylene oxide (EO/PO) block copolymers as surfactants. U.S. Pat. No. 5,536,438 discloses a cleaning composition containing four nonionic surfactants (fatty alcohol ethoxylates of different HLB values. U.S. Pat. No. 5,501,816 discloses ternary surfactant blends comprised of alcohol alkoxylate with a fatty alcohol moiety, alkylphenol alkoxylates and alkyl oxyethylate.

Broadly, the present invention is embodied in hard surface cleaning formulations comprised of a hard surface cleaning effective amount of an associative thickener and at least two nonionic surfactants selected from the group consisting of ethoxylated alcohols and ethoxylated fatty acids. The hard surface cleaning formulations of the present invention advantageously exhibit a high foam volume of at least about 150 cc when a 100 ml aqueous solution containing about 0.1 wt. % of the formulation is agitated at 2,500 rpm for a cumulative agitation period of about 1200 seconds. In addition, the formulations of the present invention exhibit satisfactory foam stability sufficient to clean at least about 25 plates (ASTM D4009-92).

Preferably, the associative thickener is the reaction product of a C6 or greater epoxide compound with a polyoxyalkylene polyol. The ethoxylated alcohols and ethoxylated fatty acids each most preferably contain C8 to C18 carbon chains which are ethoxylated with between about 3 to about 20 moles of ethylene oxide. Especially preferred ethoxylated alcohols are fatty alcohols having oxyethylate moieties of the general formula $R(OCH_2CH_2)_xOH$, wherein R is a C10 to C13 branched or straight chain alkyl group and x is within the range of about 4 to about 10. The ethoxylated alcohols which are employed in accordance with the present invention do not necessarily require the presence of only ethylene oxide groups. Instead, the ethoxylated alcohols usefully employed in the formulations of the present invention may have C3 or higher alkylene oxide groups present (for example, propylene oxide), in addition to ethylene oxide groups.

These and other aspects and advantages will become more apparent after careful consideration is given to the following detailed description of the preferred exemplary embodiments thereof.

DETAILED DESCRIPTION OF THE INVENTION

The formulations of the present invention will necessarily include an associative thickener. Preferred associative thickeners for use in the formulations of the present invention include the class of nonionic associative thickeners. The preferred associative thickeners are described for example in U.S. Pat. Nos. 4,904,466; 4,810,503; 4,673,518; 4,411,819; 4,649,224; 4,665,239 and 4,709,099, the disclosures of which are hereby incorporated by reference. As is known in the art, these thickeners are made by reacting an epoxide compound of about 6 carbons or greater with a polyoxyalkylene polyol. Useful epoxides are those with 6 carbons up to those with 20 to 45 carbon atoms. A wide range of polyoxyalkylene polyols can be used and can be diols, triols, or higher functionalities. The product of the reaction is a polyol that has large alkyl groups at its termini, the large alkyl groups being the alkyl groups on the epoxides noted above. It is believed that in aqueous solution the large alkyl groups associate with one another to form micelle-like structures, which form an extensive network throughout the solution and act to increase the viscosity.

Preferred nonionic associative thickeners are those with detergent properties. Detergent properties can be built into the associative thickener by choosing a polyoxyalkylene polyol for the reaction described in the preceding paragraph which itself has detergent properties. A polyoxyalkylene polyol has detergent properties when it has a relatively more hydrophobic part and a relatively more hydrophilic part. It is common to introduce these hydrophobic and hydrophilic parts into polyoxyalkylene polyols by preparing the polyols with blocks of polyoxyalkylenes, where adjacent blocks have different relative alkylene oxide concentrations. This principle, which is well known to those of skill in the art, is illustrated by the discussion above of the nonionic surfactants useful in the invention.

Useful nonionic associative thickeners used in the Examples are PLURACOL® AT 299 and PLURACOL® AT 301, available commercially from BASF Corporation.

The formulations of the present invention will also necessarily include at least two nonionic surfactants selected from the group consisting of ethoxylated aliphatic alcohols and ethoxylated fatty acids.

Either monohydric or polyhydric alcohols may be employed for forming the ethoxylated aliphatic alcohols for use in the formulations of the present invention. Representative monohydric alcohols include n-octyl, n-decyl, n-dodecyl (lauryl), n-tetradecyl (myristyl), n-hexadecyl (cetyl) and n-octadecyl alcohols, and mixtures thereof. Useful representative polyhydric alcohols include ethylene glycol, diethylene glycol, polyethylene glycol, sucrose, butanediol, butanediol, butanediol and hexanediol. Glycerol, sorbitol, pentaerythritol, trimethylolethane, and trimethylolpropane are particularly useful polyhydric alcohols with can be ethoxylated and subsequently esterified to produce the esters of ethoxylated and employed in the formulations of the present invention.

Representative monohydric aliphatic alcohols useful for ethoxylation are generally those having straight chains and carbon contents of between about 8 to about 18 carbon atoms. The alcohols are ethoxylated so as to add about 3 moles to about 20 moles of ethylene oxide by conventional ethoxylation procedures known to those skilled in the art. Such procedures are carried out under pressure usually in the presence of alkaline catalysts.

Preferred fatty alcohols having oxyethylate moieties are available commercially from BASF Corporation under the tradename ICONOL™ and have the general formula: $R(OCH_2\ CH_2)_xOH$, wherein R is a $C_{10}$ to $C_{13}$ branched or straight chain alkyl group and x is within the range of about 4 to 10. Preferred for use in the formulations of the present invention re ICONOL™ TDA 10, wherein $R=C_{13}$ and x=10, ICONOL™ DA4, wherein $R=C_{10}$ and x=4 and ICONOL™ DA9, wherein $R=C_{10}$ and x=9.

Useful ethoxylated aliphatic acids that may be employed in the practice of the present invention will have between about 3 to about 20 moles of ethylene oxide added per mole of acid. Examples are ethoxylated oleic acid, ethoxylated stearic acid and ethoxylated palmitic acid. Useful ethoxylated dimer acids include oleic dimer acid and stearic dimer acid. Aliphatic acids can be either branched or straight-chain and can contain from about 8 to about 36 carbon atoms. Useful aliphatic acids include azelaic acid, sebacic acid, dodecanedioic acid, caprylic acid, capric acid, lauric acid, oleic acid, stearic acid, palmitic acid and the like. Especially useful for the purpose of the present invention are the aliphatic, preferably the saturated and straight-chain mono- and dicarboxylic acids containing from about 8 to about 18 carbon atoms.

An ethoxylated tall oil with a high fraction of rosin containing tricyclic mono carboxylic acid may also be employed in the formulations of the present invention. The rosin must be of the special type that is soluble in both alcohol and mineral spirits. The tricyclic hydrocarbon chain in rosin acid contains a conjugated double bond. This conjugated double bond is available for formation of Diels-Alder type adducts by combination with other double bond containing materials. Of particular interest is the fraction which contains high amounts of dimer and trimer acids via Diels-Alder adduct formation with Gardner viscosity from 20 to 60 and Monomer acids concentration from 5 to 95%; Dimer acid concentration from 5 to 40%; and Trimer and Higher Acids 5 to 30%. Preferred monomer acid concentration is from 40 to 85%; dimer acid concentration from 10 to 35%; and trimer and higher acids concentration 5 to 25%. One particularly preferred ethoxylated tall oil product is manufactured by BASF Corporation and sold as INDUSTROL® TO1 6HR.

The ratio of one of the nonionic surfactants to another of the nonionic surfactants employed in the formulations of the present invention is most preferably between about 1:1 to about 10:1, and more preferably between about 1:1 to about 1:8. A ratio of about 1:1 is especially preferred.

The combined amount of the nonionic surfactants employed in the formulations of the present invention is most preferably between about 10 wt. % to about 25 wt. %, and more preferably between about 15 wt. % to about 20 wt. %. The associative thickener will most preferably be present in the formulations of the present invention in an amount between about 0.25 wt. % to about 5 wt. %, more preferably between about 0.5 wt. % to about 2.5 wt. %.

The balance of the formulations of the present invention will comprise water with or without optional auxiliary components commonly employed in hard surface cleaners. Exemplary auxiliary components include, for example, colorants, fragrance agents, sequesterants, viscosity modifiers, pH modifiers, antimicrobial agents, antitarnishing agents and the like. If employed in the formulations of the present invention, such auxiliary components will be present in amounts generally less than about 20 wt. %, and typically less than about 10 wt. %.

The formulations of the present invention will exhibit exceptionally high foaming properties represented by a foam volume of greater than about 150 cc, and typically greater than about 200 cc, as determined by agitating a 100 ml aqueous solution containing about 0.1 wt. % of the formulation at 2,500 rpm for at least about 1200 seconds. The formulations of the present invention will also exhibit satisfactory foam stability sufficient to clean at least about 25 plates, and typically at least about 30 plates, when tested according to ASTM D4009-92 (Method A) entitled "Standard Guide for Foam Stability of Hand Dishwashing Detergents" (incorporated herein expressly by reference).

The formulations of the present invention will also exhibit a less sensitive viscosity profile as a function of temperature as compared to conventional hard surface cleaners. Specifically, the formulations of the present invention a viscosity difference at 75° F. and 40° F. of less than about 500 cP, and preferably less than about 300 cP. The formulations of the present invention are also compatible with conventional sanitizing solutions.

The present invention will be further understood by reference to the following non-limiting Examples.

EXAMPLES

Various formulations in accordance with the present invention and several formulations outside the scope of the present invention were prepared as noted in Table 1 below using the following components:

Poly-Tergent® SL 42; SL 62: essentially 100% active, nonionic alkoxylated fatty alcohols wherein the alkoxylation is in the form of propylene oxide and ethylene oxide groups.

ICONOLT™ TDA 10; DA 6; DA 9: Fatty alcohols commercially available from BASF Corporation having oxyethylate moieties which correspond to the Formula: $R(OCH_2CH_2)_xOH$, wherein R is a $C_{10}$ to $C_{13}$ branched or straight chain alkyl group and x is within the range of about 4 to 10.

INDUSTROL® TO16HR: An ethoxylated tall oil with a high fraction of rosin containing tricyclic mono carboxylic acid.

PLUROCOL® AT299: An associative thickener commercially available from BASF Corporation which is the reaction product of an epoxide and a polyoxyalkylene polyol.

Foam Builder: lauryl amine oxide (30%).

INDUSTROL® TFA8: a fatty acid ethoxylate with 8 moles of ethylene oxide, commercially available from BASF Corporation.

The components identified in Table 1 below were mixed together (all amounts being identified as wt. %) and tested for foaming properties and foam stability according to the following test procedures:

Dynamic Foam Test: The temperature of a constant temperature bath was initially set to the desired operating temperature of 75° F. A 100 ml solution containing 0.1 wt. % of the formulation was placed in a graduated cylinder and was agitated by a mechanical mixer operated at approximately 2,500 rpm for an agitation period of about 30 seconds duration. The foam that was formed was allowed to develop a distinct liquid/foam interface and the foam volume in milliliters (cc) was recorded using the graduations of the cylinder. The 30-second agitation procedure was repeated five times followed by a single agitation period of 150 seconds once, and four agitation periods of 300 seconds with the foam volume being recorded after each such agitation period. The foam volumes were plotted as a function of total time of agitation and the foam volume identified in Table 1 below was obtained from the plot corresponding to a total agitation time of 1200 seconds.

Foam Stability Test: ASTM Method D4009-92 (Method A). Results are reported in Table 1 as Foam Stability and represent the number of soiled plates washed.

TABLE 1

| | INVENTION FORMULATIONS | | | | COMPARATIVE FORMULATIONS | | | | | |
|---|---|---|---|---|---|---|---|---|---|---|
| COMPONENT | 1 | 2 | 3 | 4 | C1 | C2 | C3 | C4 | C5 | C6 |
| ICONOL ® DA6 | 16 | | | | 16 | 16 | 15.53 | 15.38 | | |
| Foam Builder | 16 | 53.3 | 53.3 | 53.3 | 16 | 16 | 15.53 | 15.38 | 53.3 | 53.3 |
| Propylene Glycol | 10 | 10.3 | 10.3 | 10.3 | 10 | 10 | 9.71 | 9.62 | 10.3 | 10.3 |
| ICONOL ® DA9 | 2.4 | | | | 2.4 | 2.4 | 2.33 | 2.31 | | |
| Sodium citrate | 2 | 2 | 2 | 2 | 2 | 2 | 0.97 | | 2 | 2 |
| Boric acid | | | | | | 1.5 | | | | |
| Borax | | | | | | 1 | | | | |
| Monoethanolamine (MEA) | | | | | | | 2.91 | 3.85 | | |
| Glycolic acid (70%) | | | | | | | 3.88 | 4.81 | | |
| PolyTergent ® SL62 | | | 9.2 | | | | | | | |
| PolyTergent ® SL42 | | | | 9.2 | | | | | | |
| ICONOL ® TDA10 | | 9.2 | 9.2 | | | | | | | |
| ICONOL ® TFA8 | | | | | | | | | | 18.4 |
| INDUSTROL ® TO16HR | | 9.2 | | 9.2 | | | | | 18.4 | |
| AT299 | 1 | 1 | 1 | 1 | | | | | 1 | 1 |
| H2O | 14.3 | 14.3 | 14.3 | 14.3 | 16.3 | 13.77 | 11.28 | 10.73 | 14.3 | 14.3 |
| pH | 7.39 | 7.97 | 7.92 | 7.86 | 7.44 | 7.53 | 8.17 | 8.57 | nd | nd |
| Viscosity (75 F.) (cP) | 152 | 154 | nd | 144 | 119 | 131 | 130 | 119 | nd | nd |
| Viscosity (40 F.) (cP) | 434 | 495 | nd | 483 | 309 | 376 | 377 | 347 | nd | nd |
| Foam Volume (cc) | 220 | 250 | 210 | 250 | 230 | 220 | 50 | 50 | 120 | 40 |
| Foam Stability (# plates washed) | 30 | nd | nd | nd | 22.5 | 20 | nd | nd | nd | nd |

nd = not determined

As can be seen from the data in Table 1 above, those formulations in accordance with the present invention exhibited exceptionally high foam volumes as compared to those formulations outside the scope of the present invention. Although two of the comparative formulations had relatively high foam volumes (i.e., C1 and C2), they did not pass the foam stability testing. Thus, the formulations of the present invention exhibit both advantageously high foam volumes and comparable foam stability properties to commercial formulations.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A hard surface cleaning formulation comprising a hard surface cleaning effective amount of (i) between about 0.25 wt. % to about 5.0 wt. % of an associative thickener which is the reaction product of a C6 or greater epoxide compound with a polyoxyalkylene polyol, and (ii) between about 10 wt. % to about 25 wt. % of a blend including at least two nonionic surfactants selected from the group consisting of ethoxylated alcohols and ethoxylated fatty acids.

2. The formulation of claim 1, wherein the ethoxylated alcohols are C8 to C18 alcohols ethoxylated with between about 3 to about 20 moles of ethylene oxide.

3. The formulation of claim 2, wherein the ethoxylated alcohols include fatty alcohols alkoxylated with ethylene oxide groups and a C3 or higher alkylene oxide groups.

4. The formulation of claim 2, wherein the ethoxylated alcohols are C8 to C18 monohydric aliphatic alcohols ethoxylated with between about 3 to about 20 moles of ethylene oxide.

5. The formulation of claim 3, wherein the ethoxylated alcohols are fatty alcohols having oxyethylate moieties of the general formula $R(OCH_2CH_2)_xOH$, wherein R is a C10 to C13 branched or straight chain alkyl group and x is within the range of about 4 to about 10.

6. The formulation of claim 1, wherein the ethoxylated fatty acids include C8 to C18 aliphatic or dimer acids ethoxylated with between about 3 to about 20 moles of ethylene oxide.

7. The formulation of claim 1, wherein the ethoxylated fatty acid is an ethoxylated tall oil.

8. The formulation of claim 1 wherein one of the nonionic surfactants and another of the nonionic surfactants in the blend thereof are present in a ratio of between about 1:1 to about 1:10.

9. The formulation of claim 8, wherein the ratio is between 1:1 to about 1:8.

10. A hard surface cleaning formulation which comprises:

(A) between about 0.25 wt. % to about 5.0 wt. % of an associative thickener which is the reaction product of a C6 or greater epoxide compound with a polyoxyalkylene polyol; and (B) between about 10 wt. % to about 25 wt. % of at least two nonionic surfactants selected from the group consisting of (B1) C8 to C18 alcohols ethoxylated with between about 3 to about 20 moles of ethylene oxide, and (B2) C8 to C18 fatty acids ethoxylated with between about 3 to about 20 moles of ethylene oxide; wherein the formulation exhibits a high foam volume of about 150 cc or more as determined by agitating a 100 ml aqueous solution containing 0.1 wt. % of the formulation at about 2,500 rpm for a cumulative agitation period of about 1200 seconds or more, and foam stability according to ASTM D4009-92 sufficient to clean about 25 plates or more.

11. The formulation of claim 10, wherein the ethoxylated alcohols are fatty alcohols having oxyethylate moieties of the general formula $R(OCH_2CH_2)_xOH$, wherein R is a C10 to C13 branched or straight chain alkyl group and x is within the range of about 4 to about 10.

12. The formulation of claim 10, wherein the ethoxylated fatty acids include C8 to C18 aliphatic or dimer acids ethoxylated with between about 3 to about 20 moles of ethylene oxide.

13. The formulation of claim 10, wherein the ethoxylated fatty acid is an ethoxylated tall oil.

14. The formulation of claim 10 wherein the nonionic surfactants (B1) and (B2) are present in the blend thereof in a ratio between about 1:1 to about 1:10.

15. The formulation of claim 14, wherein the ratio is between 1:1 to about 1:8.

16. The formulation of claim 10, wherein the ethoxylated alcohols include fatty alcohols alkoxylated with ethylene oxide groups and a C3 or higher alkylene oxide groups.

* * * * *

UNITED STATES PATENT AND TRADEMARK OFFICE

CERTIFICATE OF CORRECTION

PATENT NO. : 6,492,317 B1
DATED : December 10, 2002
INVENTOR(S) : Kerobo et al.

It is certified that error appears in the above-identified patent and that said Letters Patent is hereby corrected as shown below:

Title page, Item [54] and Column 1, line 1,
Title, change "FORMING" to -- FOAMING --;

Title page,
Item [75], Inventors, change "Susanne M. Gessner, Ypsilant, MI (US)" to -- Suzanne M. Gessner, Detroit, MI (US) --; change "Sonia J. Patterson, Detroit, MI (US)" to -- Sonia J. Patterson, Ypsilant, MI (US) --; change "Chacji" to -- Chacko --;

Column 1,
Line 5, change "The-present" to -- The present --;
Line 10, change "Theological" to -- rheological --;

Column 3,
Line 65, change "TO1 6 HR" to -- TO16HR --;

Column 4,
Line 52, change "ICONOLT™" to -- ICONOL™ --;
Line 61, change "PLUROCOL®" to -- PLURACOL® --;

Column 5,
Table 1, change "ICONOL® TDA10" to -- ICONOL™ TDA10 --;
Table 1, change "IXDUSTROL®" to -- INDUSTROL® --.

Signed and Sealed this

Twenty-fifth Day of March, 2003

JAMES E. ROGAN
*Director of the United States Patent and Trademark Office*